US007814960B2

(12) United States Patent
Kawaguchi et al.

(10) Patent No.: US 7,814,960 B2
(45) Date of Patent: Oct. 19, 2010

(54) MOLD OSCILLATING APPARATUS

(75) Inventors: Hiroshi Kawaguchi, Takasago (JP); Hirofumi Sasaki, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 462 days.

(21) Appl. No.: 11/972,179

(22) Filed: Jan. 10, 2008

(65) Prior Publication Data

US 2008/0196857 A1 Aug. 21, 2008

(30) Foreign Application Priority Data

Feb. 21, 2007 (JP) ..... 2007-040915

(51) Int. Cl.
*B22D 11/053* (2006.01)

(52) U.S. Cl. ..... 164/416; 164/478

(58) Field of Classification Search ..... 164/478, 164/416

See application file for complete search history.

(56) References Cited

U.S. PATENT DOCUMENTS 4,678,022 A 7/1987 Lemper

*Primary Examiner*—Kuang Lin
(74) *Attorney, Agent, or Firm*—Oblon, Spivak, McClelland, Maier & Neustadt, L.L.P.

(57) ABSTRACT

In a mold oscillating apparatus according to the present invention, a connecting plate for interconnecting a moving bearing housing rotated by eccentric rotation of an eccentric shaft and a mold table oscillated by rotation of the moving bearing housing is supported by the mold table from one end of an upper end part thereof to the other end, and supported by the moving bearing housing from one end of a lower end part thereof to the other end. By such a configuration, torsional deformation of the connecting plate is prevented and a stress generated in the connecting plate is eased.

10 Claims, 12 Drawing Sheets

MOLD OSCILLATING APPARATUS

BACKGROUND OF THE INVENTION

1. Field of the Invention

The present invention relates to a mold oscillating apparatus for oscillating a mold forming a continuous casting assembly.

2. Description of the Related Art

Currently, in the continuous casting assembly, there is a known technique of using a mold oscillating apparatus for generating relative motion between a mold inner wall and a slab by oscillating a mold. By the relative motion, inflow of flux between the mold inner wall and the slab is facilitated and thereby adhesion of the slab to the mold inner wall is prevented.

For example, U.S. Pat. No. 4,678,022 discloses a mold oscillating apparatus for fixedly mounting and interconnecting a mold table in which a mold is installed and a moving bearing housing to each other by a connecting beam.

In the mold oscillating apparatus, the moving bearing housing fitted onto both end parts of a drive shaft through a bearing and moved by eccentric rotation of the drive shaft is rotatably provided, and a connecting beam is provided between the moving bearing housings arranged in the both ends of the drive shafts. One end of a lower end part of the connecting beam is fixedly mounted to one of the moving bearing housings, while the other end of the lower end part of the connecting beam is fixedly mounted to the other moving bearing housing. Meanwhile, one end to the other end of an upper end part thereof is abutted and fixedly mounted to a lower surface of the mold table.

In the mold oscillating apparatus, a tie rod for regulating lateral displacement of the mold table is arranged. Thereby, the moving bearing housing performs rotation motion by the eccentric rotation of the drive shaft, while the lateral displacement as a component of the motion transmitted from the moving bearing housing to the mold table is prevented by the tie rod, and the mold table is oscillated only in the up and down direction. The lateral displacement as a component of the motion is absorbed by deflection of the connecting beam.

However, in the connecting beam according to the above mold oscillating apparatus, although the both ends of the lower end part are supported by the moving bearing housing, a space between the moving bearing housings is not supported and held up in the air. Therefore, flexural deformation of the connecting beam due to the motion of the moving bearing housing is limited to interconnecting portions of the moving bearing housing on the both sides and the vicinity thereof. In other words, the entire connecting beam is not uniformly flexed, and an amount of the flexural deformation of the connecting beam is decreased as departing from both ends of the connecting beam (interconnecting points with the moving bearing housings). Particularly, in a large sized mold supporting apparatus, the connecting beam is also long and large. Therefore, it can be thought that a central part of such a connecting beam is not at all flexed.

As mentioned above, when "local deformation (deflection)" is only generated in the both end parts of the connecting beam, "torsional" deformation is generated between the both end parts and the central part of the connecting beam. The "local deformation (deflection)" generates the "torsion" in the connecting beam, and thereby a stress due to the "torsional deformation" is added to the connecting beam. Since the connecting beam receives a cyclic stress due to oscillation of the mold, there is a fear that even a relatively small stress generated causes crack and finally leads to breakage.

In order to avoid such a situation, it can be thought that the connecting beam is exchanged before leading to the breakage. However, since the connecting beam itself is a large sized part, the exchange is extremely uneconomical and an exchange work is not easy.

In recent years, in order to reduce an oscillation mark of the slab so as to improve quality of a surface of the slab, there is sometimes a case where a mold oscillating apparatus with high cycle of approximately 7 Hz is adapted. In such an operating method, since the number of cyclic deformation to the connecting beam in drive time of a mold drive apparatus is further increased, the life of the connecting beam before leading to the breakage is further shortened.

SUMMARY OF THE INVENTION

It is an object of the present invention to provide a mold oscillating apparatus capable of eliminating torsional deformation of a connecting member for interconnecting moving bearing housing moved by eccentric rotation of eccentric shafts and a mold table oscillated by rotation of the moving bearing housing, and easing a stress generated in the connecting member.

In order to achieve the above object, the following technical means is provided in the present invention.

That is, the technical means for solving problems in the present invention is a mold oscillating apparatus, comprising a mold table for supporting a mold, a base frame for supporting the mold table on the upper side or the lower side thereof, and an oscillation mechanism for oscillating the mold table, the oscillation mechanism being arranged between the base frame and the mold table, the oscillation mechanism comprising drive means, a stationary bearing housing interconnected to the base frame, a moving bearing housing interconnected to the mold table, oscillation generating means provided with a shaft interconnected to the drive means, the shaft having a shaft portion supported by the stationary bearing housing and an eccentric shaft portion supported by the moving bearing housing, oscillation direction regulating means for regulating lateral displacement and accepting up and down displacement, in oscillation of the mold table generated by the oscillation generating means, and a connecting plate arranged between the moving bearing housing and the mold table, the connecting plate extending in the axial direction of the shaft, being supported by the mold table from one end of an end part opposing to the mold table to the other end, and being supported by the moving bearing housing from one end of an end part opposing to the moving bearing housing, wherein the connecting plate absorbs the lateral displacement regulated by the oscillation direction regulating means with elastic deformation.

According to the above, deflection of the connecting plate due to lateral displacement motion included in motion of the moving bearing housing is uniformly generated from one end to the other end, and hence there is no fear that torsional deformation is generated in the connecting plate.

Therefore, a stress generated in the connecting plate is mainly due to the above deflection, and it is possible to make the stress smaller than the case where the torsional deformation is generated at the same time. As a result, the life of the connecting plate is prolonged.

Preferably, the shaft of the mold oscillating apparatus is provided with the eccentric shaft portion on both ends thereof respectively, and the eccentric shaft portion is supported by the moving bearing housing respectively.

According to the above, a size of the connecting plate is reduced, and it is possible to relatively easily perform an exchange work of the connecting plate.

As the connecting plate has higher rigidity to bending, the deflection of the connecting plate mentioned above is a more stress (resistance) to an oscillating source. However, according to the above configuration, since a width size of the connecting plate is reduced, it is possible to reduce the bending rigidity of the connecting plate and also reduce power required for oscillating.

Preferably, at least a pair of the oscillation mechanisms are arranged between the base frame and the mold table, and shaft centers of the shafts of the oscillation mechanisms are parallel to each other.

According to the above, it is possible to oscillate the mold table in a more stabilized state.

In a pair of the oscillation mechanisms, an eccentricity of the eccentric shaft portion provided in one of the shafts may be set to have a different value from an eccentricity of the eccentric shaft portion provided in the other shaft.

According to the above, it is possible to oscillate the mold table on a circumferential orbit in an imaginary arc shape so as to use in a curved type continuous casting assembly.

Preferably, in a pair of the oscillation mechanisms, the rotation direction of one of the shafts and the rotation direction of the other shaft are set to be opposite to each other.

According to the above, since a pair of the shafts are rotated so as to diminish lateral run-out of each other, it is possible to further stabilize a posture of the mold table.

Preferably, the connecting plate is fixed by fitting an upper end part thereof to a groove portion provided in the mold table. Moreover preferably, the connecting plate is fixed by fitting a lower end part thereof to a groove portion provided in the moving bearing housing.

According to the above, a shape of the connecting plate is simplified. The exchange work of the connecting plate is further easily performed.

Preferably, the connecting plate has high fatigue property to bending deformation due to the lateral displacement included in motion of the moving bearing housing upon rotation of the eccentric shaft portion of the shaft, and strength capable of avoiding buckling due to a compressive load from the mold table and deformation in an upper end part thereof interconnected to and supported by the mold table and a lower end part thereof interconnected to and supported by the moving bearing housing due to the compressive load.

Since the connecting plate has the deformability and the strength mentioned above, it is possible to properly generate the deflection in the connecting plate and also support the mold table through the connecting plate.

Preferably, the connecting plate is provided with one thick plate portion interconnected to and supported by the mold table on an upper end part thereof, the other thick plate portion interconnected to and supported by the moving bearing housing on a lower end part thereof, and a thin plate portion extending between a pair of the thick plate portions, and an interconnecting portion of the thick plate portion and the thin plate portion is chamfered.

According to the above, it is possible to ease a pressure of contact surface generated between the connecting plate and the mold table and the moving bearing housing, and the deformation of the upper and lower ends of the connecting plate supported by the mold table and the moving bearing housing is prevented. By easing the pressure of contact surface, it is possible to prevent the deformation of an abutted surface (groove bottom) of the connecting plate. Since the thin plate portion is between a pair of the thick plate portions, the deformability of the connecting plate is ensured by the thin plate portion.

Further, since the interconnecting portion of the thick plate portions and the thin plate portion is chamfered, concentration of the stress generated in the interconnecting portions is eased.

It should be noted that as the configuration for chamfering, a configuration of a smoothly curved shape such as an arc shape and an elliptical arc shape can be adapted as well as a configuration close to the configuration of a smoothly curved shape by interconnecting a plurality of inclined surfaces, and a configuration of a tapered shape.

As a material forming the connecting plate having such a function, spring steel or the like is preferable. Thereby, the connecting plate has sufficient deformability.

DESCRIPTION OF THE PREFERRED EMBODIMENTS

Hereinafter, an embodiment of the present invention will be specifically described along the drawings.

Figure 9:
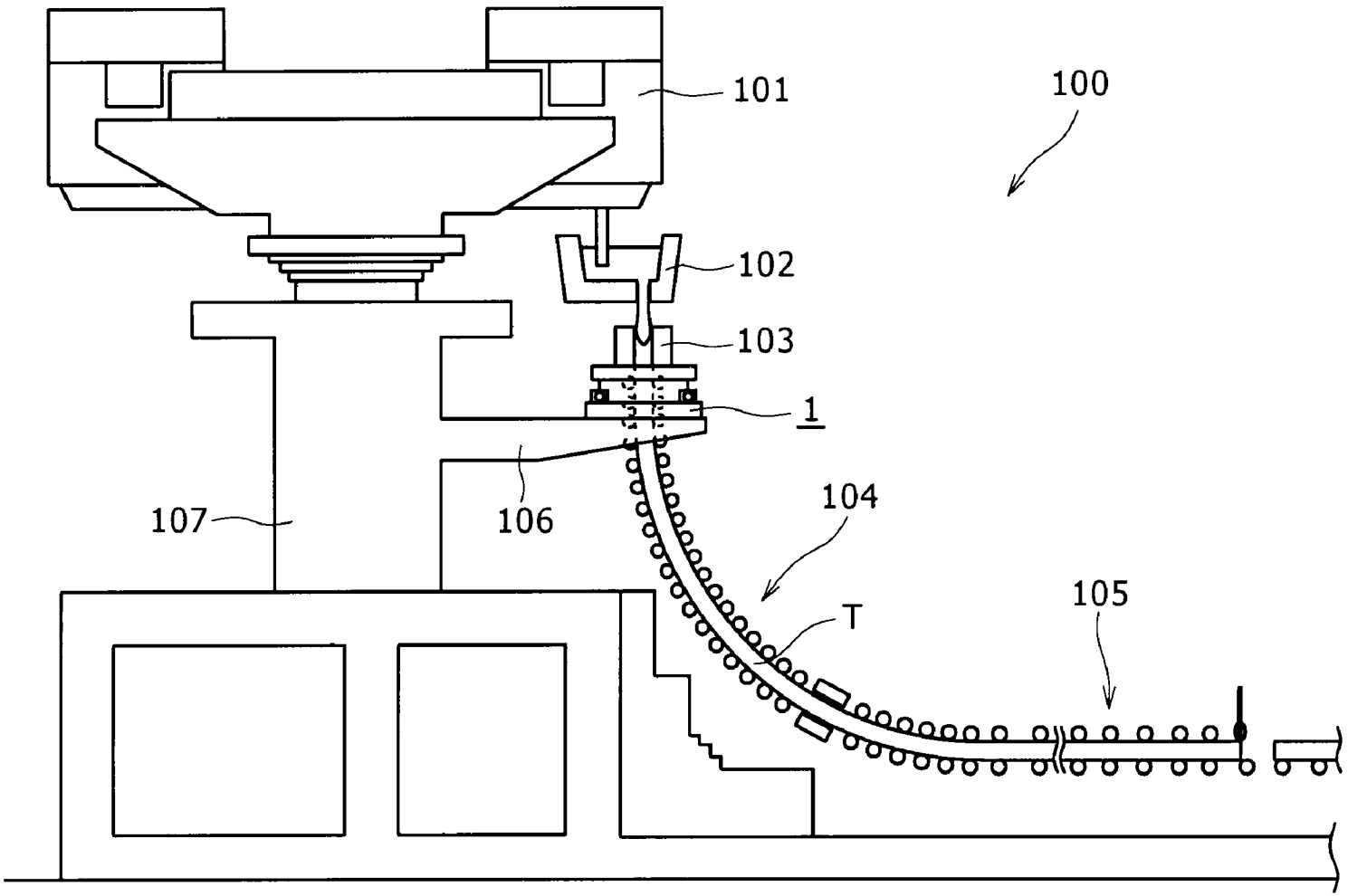
FIG. 9 is a side view of a continuous casting assembly.

As shown in FIG. 9, in a continuous casting assembly 100 having a mold oscillating apparatus 1 according to the present invention, a tundish 102 is arranged on the lower side of a ladle 101, a mold 103 is arranged on the lower side of the tundish 102, a secondary cooling belt 104 including a plurality of support rolls and cooling sprays extends taking the lower side of the mold 103 as a starting end part, and a drawing apparatus 105 is arranged in a terminal end part of the secondary cooling belt 104. Molten steel T flown from the ladle 101 to the tundish 102 is formed into a shape and then drawn by the support rolls of the secondary cooling belt 104 and the drawing apparatus 105. Therefore, the molten steel T is cooled down when passing through the secondary cooling belt 104 so that a slab (or bloom, billet) is formed.

The ladle 101 is mounted on a swing tower 107. The mold 103 is supported by an arm portion 106 extending from the swing tower 107 through the mold oscillating apparatus 1.

Figure 1:
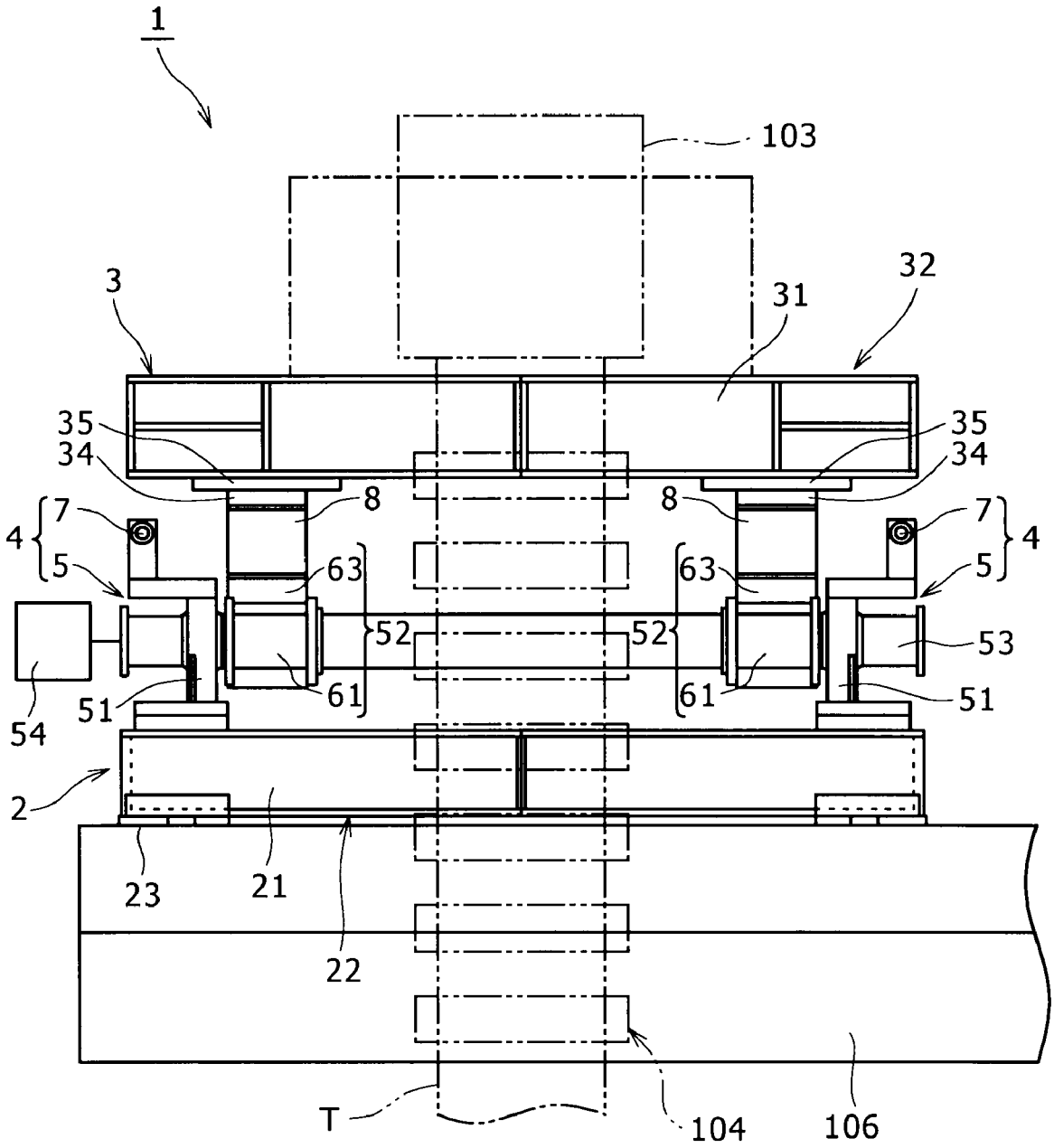
FIG. 1 is a front view of a mold oscillating apparatus according to the present invention.
Figure 2:
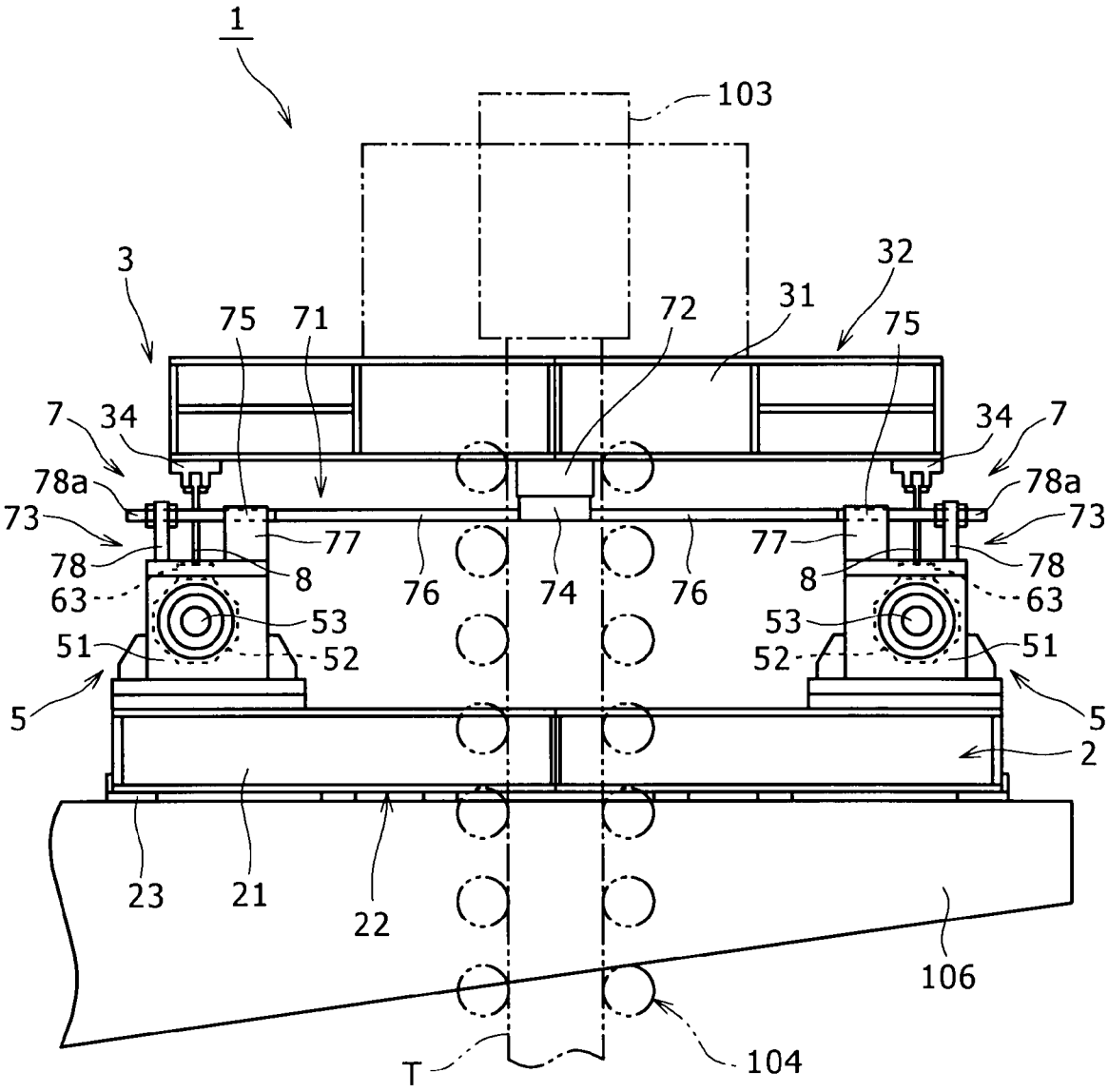
FIG. 2 is a side view of the mold oscillating apparatus.
Figure 3:
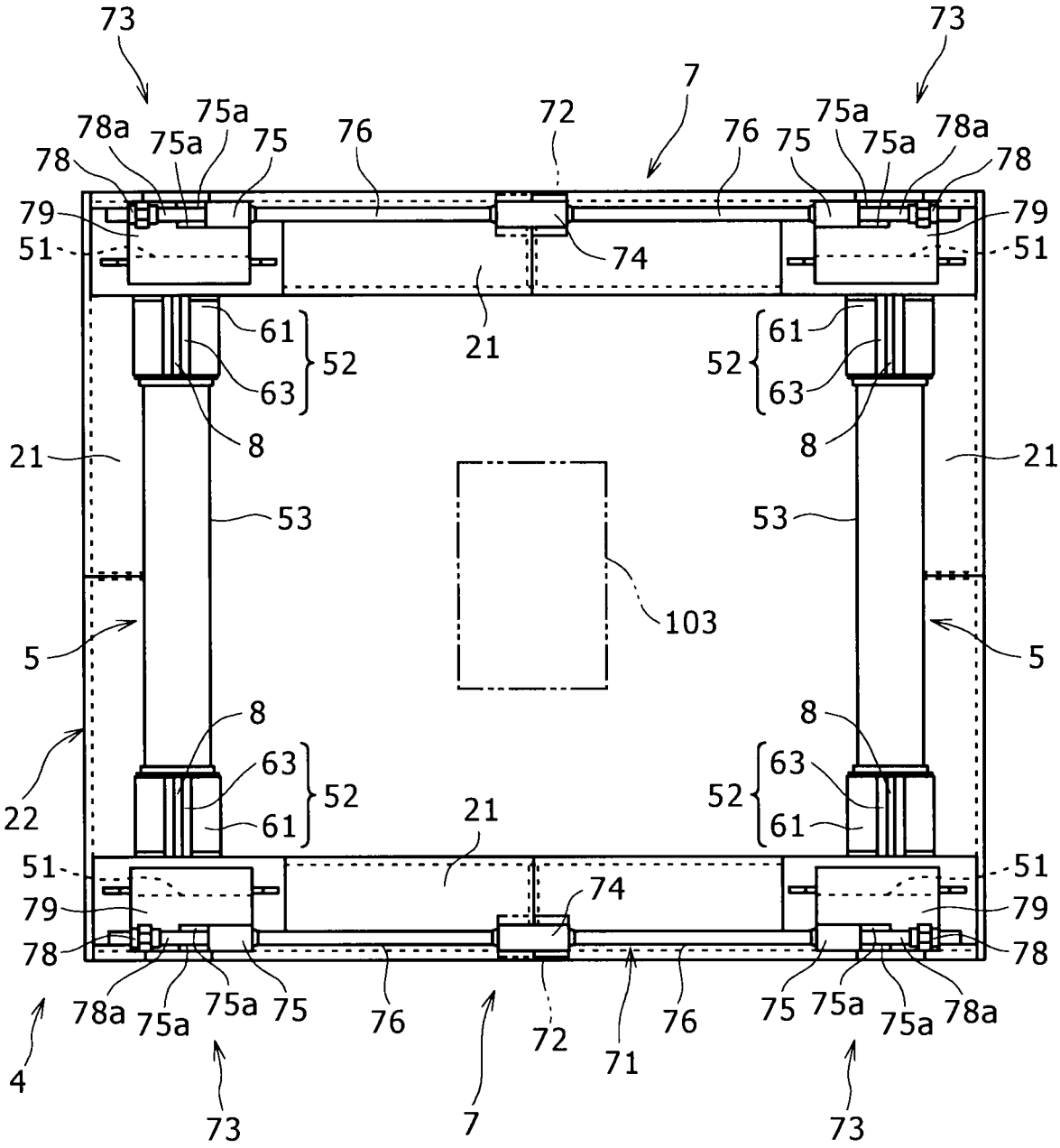
FIG. 3 is a plan view of a base frame and an oscillating mechanism.

As shown in FIGS. 1 to 3, the mold oscillating apparatus 1 is provided with a base frame 2 and a mold table 3 on the upper side of the base frame 2, and further provided with an oscillating mechanism 4 for oscillating the mold table 3 between the base frame 2 and the mold table 3.

The base frame 2 is provided with a frame body 22 formed by interconnecting four beam members 21 in a quadrilateral shape in a plan, and a plurality of interconnecting plates 23 provided in a lower end part of the frame body 22 for interconnecting the frame body 22 to the arm portion 106.

The mold table 3 is provided with a frame body 32 formed by interconnecting four horizontal members 31 in a quadrilateral shape in a plan, bracket portions (not shown) provided in upper end parts of the horizontal members 31 for supporting the mold 103, and a pair of interconnecting portions 34 respectively provided in lower end parts of a pair of the horizontal members 31 opposing to each other.

The base frame 2 and the mold table 3 are formed in the substantially same size in a plan and arranged in a state that tip parts thereof are opposing to each other.

The oscillating mechanism 4 is provided between the horizontal member 31 of the mold table 3 having a pair of the interconnecting portions 34 and the beam member 21 of the base frame 2 opposing to the horizontal member 31. That is, in the present embodiment, a pair of the oscillating mechanisms 4 are arranged between the base frame 2 and the mold table 3. Since configurations of a pair of the oscillating mechanisms 4 are the same, hereinafter, the configuration of one of the oscillating mechanisms 4 is only described. The configuration of the other oscillating mechanism 4 is given the same reference numerals and description thereof is omitted.

The oscillating mechanism 4 is provided with oscillation generating means 5 for generating oscillation to the mold table 3, and oscillation direction regulating means 7 for regulating the oscillating direction of the mold table 3 in accordance with the oscillation generating means 5.

The oscillation generating means 5 is provided with a pair of stationary bearing housings 51 interconnected to the base frame 2, a pair of moving bearing housings 52 interconnected to the mold table 3, a main shaft 53 for supporting a pair of the stationary bearing housings 51 as well as a pair of the moving bearing housings 52, and drive means 54 for giving a rotation drive force to the main shaft 53.

As shown in FIG. 1, the main shaft 53 is arranged between a pair of the interconnecting portions 34 of the mold table 3 and the beam members 21 opposing to a pair of the interconnecting portions 34. The main shaft 53 is provided with a shaft portion 55 having a shaft center extending in the horizontal direction and an entire length from one end to the other end of the beam member 21, and a pair of eccentric shaft portions 56 formed in the vicinity of both end parts of the shaft portion 55 opposing to a pair of the interconnecting portions 34 of the mold table 3. The eccentric shaft portion 56 has an eccentric shaft center 56*a* parallel to a shaft center 55*a* of the shaft portion 55.

Figure 5:
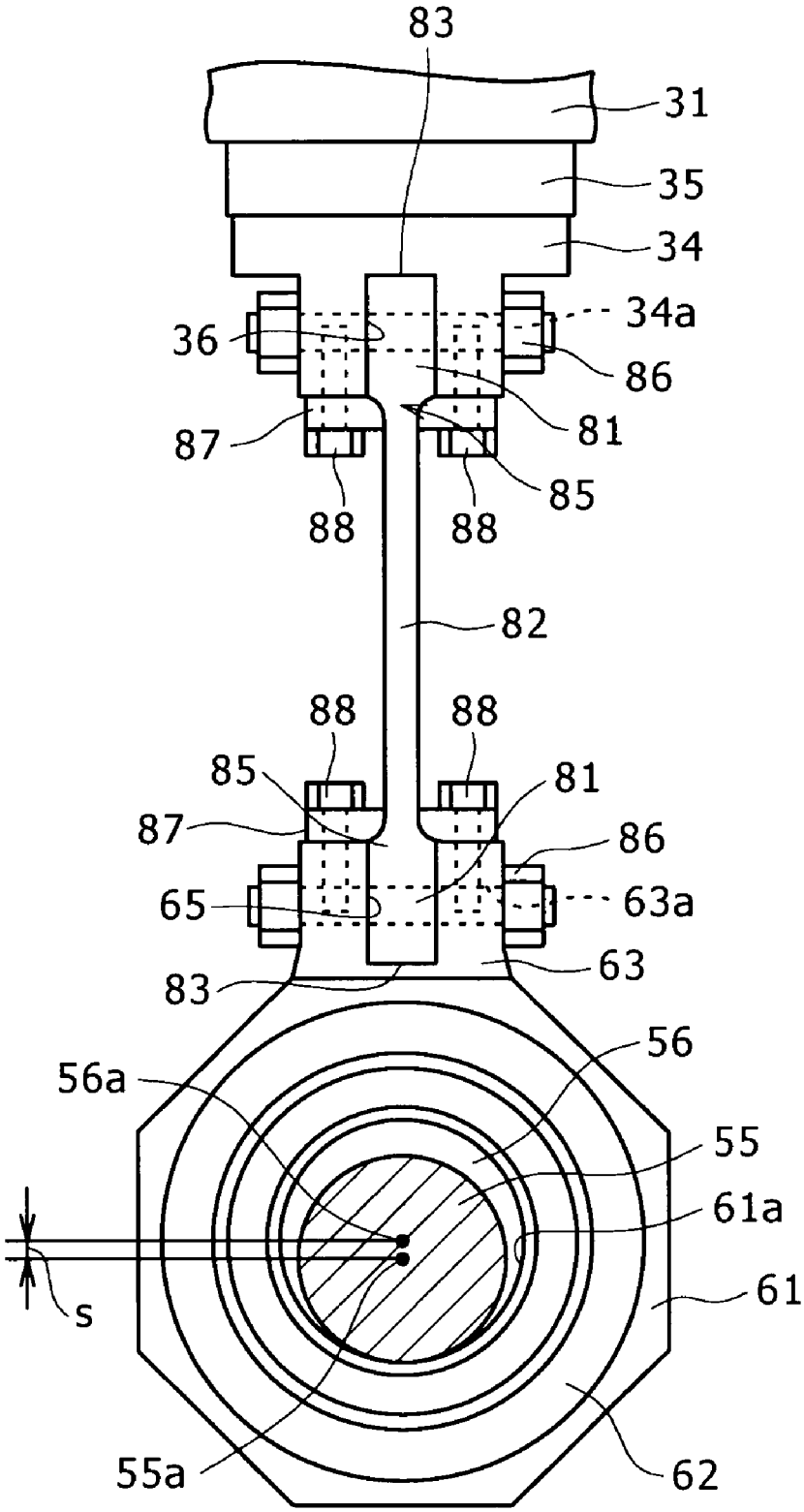
FIG. 5 is a side view showing a connecting and supporting state of a connecting plate.

It should be noted that a space S between the shaft center 55*a* of the shaft portion 55 of the main shaft 53 and the eccentric shaft center 56*a* of the eccentric shaft portion 56 shown in FIG. 5 shows an eccentric amount of the eccentric shaft center 56*a* to the shaft center 55*a*.

Figure 4:
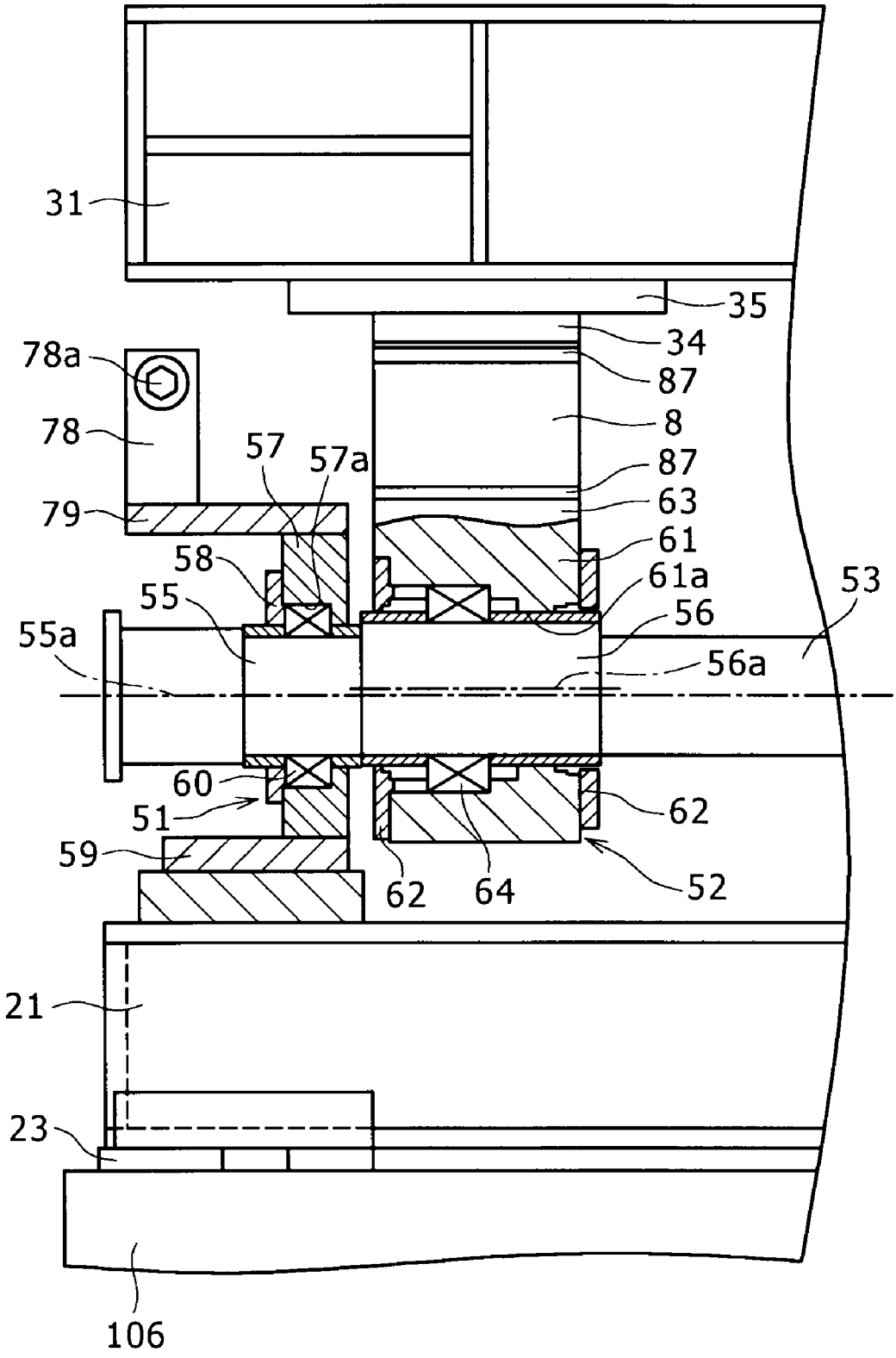
FIG. 4 is a partially broken side view showing oscillation generating means and a periphery thereof.

The stationary bearing housing 51 is arranged at a position capable of supporting the shaft portion 55 on the front end side of the eccentric shaft portion 56 of the main shaft 53. As shown in FIG. 4, the stationary bearing housing 51 has a casing 57 with a one opening surface into which the shaft portion 55 is insertable, a lid body 58 for closing the one opening surface of the casing 57, and a flange 59 protrudingly provided in the casing 57 for interconnecting the casing 57 to the base frame 2.

In the casing 57, a through hole 57*a* passing through a pair of flat plate surfaces is formed, and the shaft portion 55 is inserted into the through hole 57*a*. Within the through hole 57*a*, a bearing 60 fitted onto the shaft portion 55 is housed.

The moving bearing housing 52 is arranged at a position opposing to the stationary bearing housing 51 in the shaft center 55*a* direction of the main shaft 53, and supports the eccentric shaft portion 56 of the main shaft 53. The moving bearing housing 52 is provided with a cylindrical body 61 into which the eccentric shaft portion 56 of the main shaft 53 is insertable, a pair of lid bodies 62 arranged along end surfaces of the cylindrical body 61 perpendicular to the shaft center 55*a* for covering the end surfaces, and an attachment portion 63 arranged on the outer periphery of the cylindrical body 61.

As shown in FIG. 5, the cylindrical body 61 is formed in an octagon shape having a shaft center, and has a through hole 61*a* passing through a pair of the end surfaces perpendicular to the shaft center, and the eccentric shaft portion 56 is inserted into the through hole 61*a*. As shown in FIG. 4, within the through hole 61*a*, a bearing 64 fitted onto the eccentric shaft portion 56 is housed.

The attachment portion 63 is provided along the shaft center 55*a* of the cylindrical body 61 from the one end surface side of one outer periphery surface to the other end surface side. As shown in FIG. 5, in the attachment portion 63, a groove portion 65 along the shaft center 55*a* of the cylindrical body 61 is provided. The groove portion 65 is formed so as to have a sectional shape provided in the radial direction of the shaft center 55*a* of the cylindrical body 61 from the one edge side of the cylindrical body 61 to the other edge side. In the attachment portion 63, at one or more positions (at one position in the present embodiment), a bolt hole 63*a* orthogonal to the groove portion 65 is formed.

The interconnecting portion 34 of the mold table 3 is formed so as to have the same length or the substantially same length as a length of the cylindrical body 61 (the attachment portion 63) along the shaft center 55*a* direction of the shaft portion 55 of the main shaft 53 arranged between the mold table 3 and the base frame 2 as mentioned above. The interconnecting portion 34 is attached to a lower end part of the horizontal member 31 through a plate 35. In the interconnecting portion 34, a groove portion 36 capable of opposing to the groove portion 65 of the attachment portion 63 is provided. The groove portion 36 has the same sectional shape as the groove portion 65 of the attachment portion 63, and is formed from one end part in the longitudinal direction of the interconnecting portion 34 to the other end part. In the interconnecting portion 34, at one or more positions (at one position in the present embodiment), a bolt hole 34*a* orthogonal to the groove portion 36 is formed.

Although the drive means 54 is arranged on the side of the mold table 3 and the base frame 2, the drive means 54 may be arranged in the base frame 2.

The moving bearing housing 52 of the oscillating mechanism 4 is interconnected to the mold table 3 through one connecting plate 8.

Figure 6:
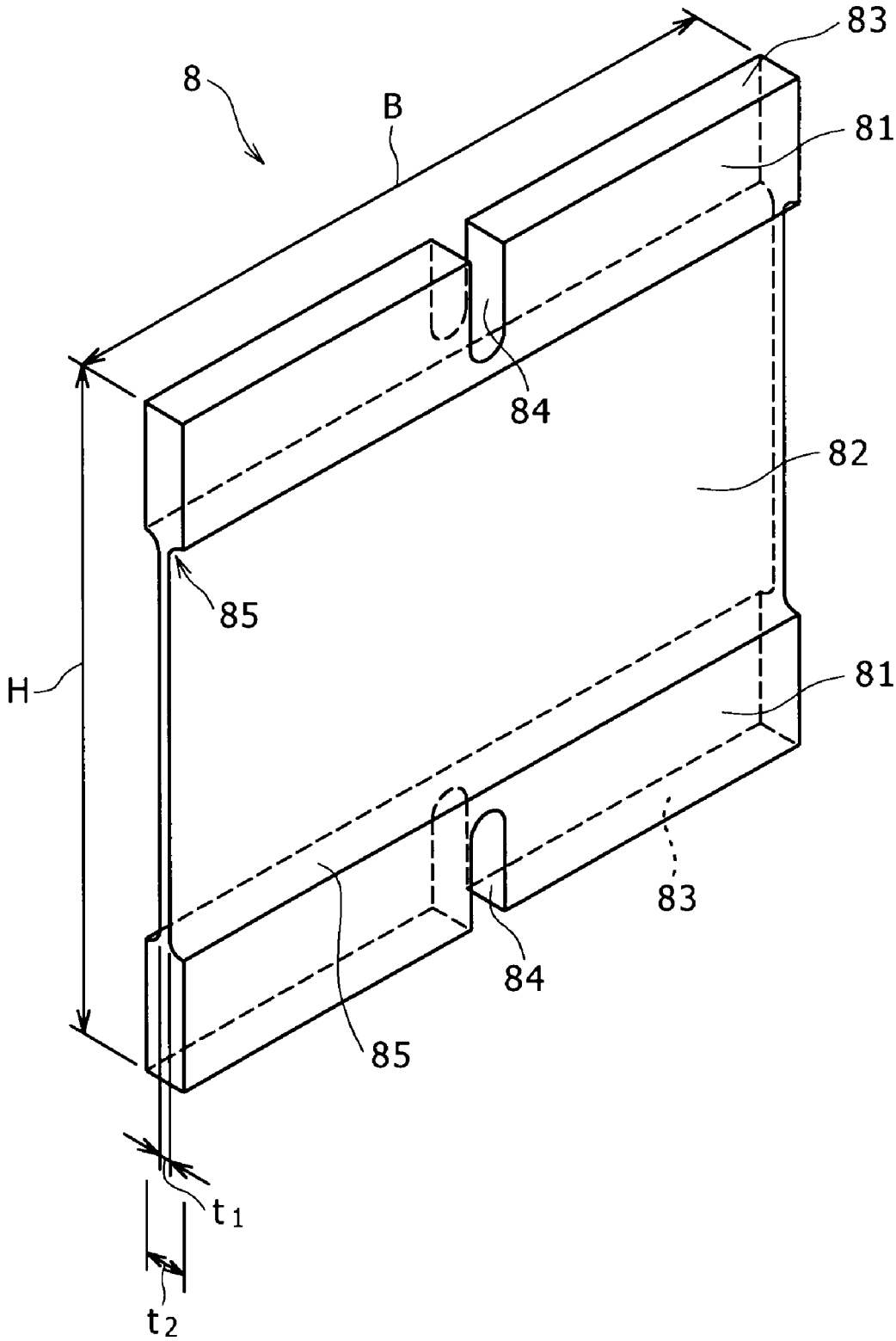
FIG. 6 is a perspective view of the connecting plate.

The connecting plate 8 is formed into a rectangular shape by spring steel in a plate shape. As shown in FIG. 6, the connecting plate 8 is provided with, a pair of thick plate portions 81 in a pair of end parts thereof opposing to each other, and a thin plate portion 82 extending between a pair of the thick plate portions 81. The connecting plate 8 is also formed as an integrated object. From such a point of view, a pair of the thick plate portions 81 of the connecting plate 8 are continuously formed through the thin plate portion 82.

The thick plate portion 81 is formed so as to have a constant thickness from one side part among a pair of side parts thereof orthogonal to a pair of the end parts to the other side part. Thereby, width of cut end surfaces 83 of a pair of the end parts of the connecting plate 8 is larger than a thickness of the thin plate portion 82. In a central part of the thick plate portion 81, an opening 84 is provided from the cut end surfaces 83 to the thin plate portion 82. In the thick plate portion 81, an interconnecting end 85 thereof interconnected to the thin plate portion 82 is chamfered in an arc shape on the both sides. Thereby, the thick plate portion 81 and the thin plate portion 82 are smoothly interconnected to each other without an internal corner or an external corner. There is no fear that concentration of a large stress leading to breakage of the connecting plate 8 is generated in the interconnecting end 85 and in the vicinity thereof.

It should be noted that as a configuration for chamfering, a configuration of a smoothly curved shape such as an arc shape and an elliptical arc shape as mentioned above can be adapted as well as a configuration close to the configuration of a smoothly curved shape by interconnecting a plurality of inclined surfaces, and a configuration of a tapered shape.

As shown in FIG. 5, by fastening one of the thick plate portions 81 by a fastening tool such as a bolt in a state that the thick plate portion 81 is housed in the groove portion 36 of the interconnecting portions 34 of the mold table 3, and also fastening the other thick plate portion 81 by the fastening tool such as the bolt in a state that the other thick plate portion 81 is housed in the groove portion 65 of the attachment portion 63 of the moving bearing housing 52, the connecting plate 8 is arranged between the moving bearing housing 52 and the mold table 3. It should be noted that the fastening tool is only exemplified as one of fixing means for fixing the thick plate portion 81 to the groove portion 36, and hence not limited to the above.

Here, one of the thick plate portions 81 is housed in the groove portion 36 from one end thereof to the other end in a state that the cut end surface 83 is brought in contact with a bottom part of the groove portion 36 of the interconnecting portion 34. The opening 84 of the thick plate portion 81 opposes to the bolt hole 34*a* of the interconnecting portion 34. By inserting and fastening a bolt 86 into the bolt hole 34*a* and the opening 84, the thick plate portion 81 is held by the interconnecting portion 34 and fixed so as not to move in the anti-plane direction. When the thick plate portion 81 is housed in the groove portion 36, the interconnecting end 85 of the thick plate portion 81 to the base end side of the interconnecting portion 34 protrudes slightly over an end surface on the front side of the interconnecting portion 34. The protruding interconnecting end 85 and the end surface of the interconnecting portion 34 are covered by a cover member 87, and the cover member 87 is fastened to the interconnecting portion 34 by a plurality of fastening tools 88 such as bolts. Therefore, the interconnecting end 85 is held down by the cover member 87. By a pressure bonding force of the holding-down, a fall or displacement of the thick plate portion 81 from the groove portion 36 of the interconnecting portion 34 is prevented.

Similarly, the other thick plate portion 81 is housed in the groove portion 65 from one end thereof to the other end in a state that the cut end surface 83 is brought in contact with the bottom part of the groove portion 65 of the attachment portion 63. The opening 84 of the other thick plate portion 81 opposes to the bolt hole 63*a* of the attachment portion 63. By inserting and fastening the bolt 86 into the bolt hole 63*a* and the opening 84, the other thick plate portion 81 is held by the attachment portion 63 and fixed so as not to move in the anti-plane direction. When the other thick plate portion 81 is housed in the groove portion 65, the interconnecting end 85 of the other thick plate portion 81 to the base end side of the attachment portion 63 protrudes slightly over an end surface on the front side of the attachment portion 63. The protruding interconnecting end 85 and the end surface of the attachment portion 63 are covered by the cover member 87, and the cover member 87 is fastened to the attachment portion 63 by the plurality of fastening tools 88 such as the bolts. Therefore, the interconnecting end 85 is held down by the cover member 87. By the pressure bonding force of the holding-down, the fall or the displacement of the other thick plate portion 81 from the groove portion 65 of the attachment portion 63 is prevented.

In the present embodiment, the bolt 63*a* is a reamer bolt, and fitted to a side part of a U-shape opening portion of the opening 84 in a state that there is almost no space therebetween. By the fitting, the mold table 3 is positioned to the base frame 2. At the same time, by the fitting, displacement of the connecting plate 8 in the groove portion 36 and the groove portion 65 is prevented. A bonding force between the attachment portion 63 or the interconnecting portion 34 and the connecting plate 8 by fastening with the bolt 63*a* and the fastening tools 88 is sufficient. However, by fitting the bolt 63*a* to the opening 84, the displacement is more surely prevented.

As mentioned above, by interconnecting the thick plate portion 81 of the connecting plate 8 to the attachment portion 63 of the moving bearing housing 52 and the interconnecting portion 34 of the mold table 3, the motion of the thick plate portions 81 in the in-plane direction and the anti-plane direction and the bending are prevented. Since the connecting plate 8 is arranged between the mold table 3 and the moving bearing housing 52 as mentioned above, the connecting plate 8 supports the mold table 3 and the mold 103. That is, compressive load from the mold table 3 and the mold 103 works on the connecting plate 8. The compressive load works on the cut end surface 83 of the thick plate portion 81 as a pressure of contact surface.

As shown in FIG. 2, the oscillation direction regulating means 7 has a tie rod 71, a linking material 72 for linking the tie rod 71 to the mold table 3, and interconnecting means 73 for interconnecting the tie rod 71 and the base frame 2.

The linking material 72 is orthogonal to a pair of the horizontal members 31 of the mold table 3 and attached to lower end parts of a pair of the horizontal members 31 for interconnecting a pair of the horizontal members 31 to each other.

The tie rod 71 is respectively provided with outer base portions 75 interconnected to the interconnecting means 73 on the both sides of a middle base portion 74 interconnected to the linking material 72. One of the outer base portions 75 and the middle base portion 74 are interconnected to each other by an elongate rod shape portion 76, and the other outer base portion 75 and the middle base portion 74 are interconnected to each other by an elongate rod shape portion 76. In the outer base portion 75, a pair of protruding pieces 76*a* protruding in the opposite direction to the rod shape portion 76 are protrudingly provided.

The interconnecting means 73 is provided with a first fixing portion 77 for fixing a main body part of the outer base portion 75, an interconnecting tool 78*a* in a rod shape interconnected to a pair of the protruding pieces 76*a*, a second fixing portion 78 for fixing the interconnecting tool 78*a*, and a base plate 79 interconnected to the stationary bearing housing 51 in a state of supporting the first fixing portion 77 and the second fixing portion 78.

The middle base portion 74 of the tie rod 71 is fastened to the linking material 72 through the fastening tool such as the bolt, and the outer base portion 75 is fastened to the first fixing portion 77 and the second fixing portion 78 of the interconnecting means 73 through the fastening tool such as the bolt. Thereby, the tie rod 71 is fastened to the mold table 3 and also to the base frame 2. The tie rod 71 is arranged orthogonal to the shaft center of the main shaft 53. Therefore, even when the mold table 3 is moved by eccentric rotation of the main shaft 53, a lateral component of the motion of the mold table 3 works on the tie rod 71 fastened to the mold table 3 or the base frame 2 so as not to move in the axial direction, and thereby the motion of the mold table 3 in the horizontal direction is regulated. Meanwhile, since the tie rod 71 is formed into an elongate shape, a shaft center thereof may be flexed in the perpendicular direction. Therefore, even when an up and down component of the motion of the mold table 3 works on the tie rod 71, a central part of the tie rod 71 is flexed in accordance with the motion of the mold table 3 taking both end parts thereof supported by the interconnecting means 73 as supporting parts. Thereby, the motion of the mold table 3 in the up and down direction is accepted.

It should be noted that the deflection of the tie rod 71 is extremely small, and hence there is no fear that the deflection causes the breakage of the tie rod 71.

The mold oscillating apparatus 1 according to the present invention is configured as mentioned above. Next, an action of the mold oscillating apparatus 1 will be described.

Firstly, the drive means 54 is driven and the main shaft 53 of the oscillating mechanism 4 is rotated in a state of synchronization. At that time, a pair of the main shafts 53 are rotated in the reversed direction to each other. Thereby, lateral runout of the mold table 3 which may be caused by the rotation of the main shafts 53 is diminished.

It should be noted that a configuration that a pair of the main shafts 53 are rotated in the same direction as each other may be adapted. In any case, rotation of the eccentric shaft portions 56 of the main shafts 53 are the same phase, that is, timing on a top dead center and a bottom dead center of the eccentric shaft portions 56 correspond to each other.

As mentioned above, when the shaft portion 55 of the main shaft 53 is rotated around the shaft center 55*a*, the eccentric shaft center 56*a* of the eccentric shaft portion 56 of the main shaft 53 is rotated around the shaft center 55*a* of the shaft portion 55 on a circular orbit. Thereby, the eccentric shaft portion 56 performs the eccentric rotation.

The moving bearing housing 52 fitted onto the eccentric shaft portions 56 so as to be capable of performing relative rotation performs the relative motion to the eccentric shaft portion 56. That is, by rotating the main shafts 53, the moving bearing housing 52 is displaced along the circular orbit without changing a posture thereof which is interconnected to the mold table 3.

Here, the mold table 3 can be moved in the up and down direction by moving direction regulating means, while not moved in the lateral direction. Therefore, the connecting plate 8 for interconnecting the mold table 3 and the moving bearing housing 52 can be rotationally displaced with the moving bearing housing 52 since the lower end part thereof is interconnected to the moving bearing housing 52. Meanwhile, since the upper end part thereof is interconnected and moved to the mold table 3, the connecting plate 8 can be displaced only in the up and down direction. However, among an up and down displacement component and a lateral displacement component forming the rotation displacement of the moving bearing housing 52, only the up and down displacement component is transmitted to the mold table 3 through the connecting plate 8, and the mold 103 is moved in the up and down direction. The lateral displacement component is absorbed by bending deformation of the thin plate portion 82 of the connecting plate 8.

In the connecting plate 8, as mentioned above, one of the thick plate portions 81 is fitted and fixed to the interconnecting portion 34 of the mold table 3 over the entire surface thereof from one end part to the other end part, and the other thick plate portion 81 is fitted and fixed to the attachment portion 63 of the moving bearing housing 52 over the entire surface thereof from one end part to the other end part. Fixing conditions for the both thick plate portions 81 are the same. Therefore, on the thin plate portion 82 of the connecting plate 8, the lateral displacement component works uniformly from one side part thereof to the other side part. Thereby, the thin plate portion 82 is uniformly bending-deformed. That is, the thin plate portion 82 is uniformly flexed, torsional deformation generated by a difference between deflection on the one side part side of the thin plate portion 82 and deflection on the other side part side is not generated due to the bending deformation.

According to the present embodiment, by rotating the main shaft 53, the moving bearing housing 52 is rotationally displaced. Although the lateral displacement component of the rotational displacement periodically works on the connecting plate 8, the lateral displacement component is fully absorbed by cyclic bending deformation of the connecting plate. The up and down displacement component of the rotational displacement is transmitted to the mold table 3 through the connecting plate 8. Thereby, the mold table 3 and the mold 103 are oscillated only in the up and down direction.

The connecting plate 8 not only receives the compressive load from the mold 103 and the mold table 3 as mentioned above, but also is repeatedly bending-deformed.

Therefore, the connecting plate 8 has: (A) high fatigue property to the bending deformation; (B) strength capable of avoiding buckling due to the compressive load from the mold table 3 and the mold 103; and (C) strength capable of avoiding deformation in the both thick plate portions 81 due to the compressive load.

In the present embodiment, in order to give the above properties to the connecting plate 8, the connecting plate 8 is formed by spring steel as a material with length H from an upper edge to a lower edge of 150 mm, and length B from one side edge to the other side edge of 250 mm. The thin plate portion 82 is formed with a thickness $t_1$ of 6 mm, and the thick plate portion 81 is formed with a thickness $t_2$ of 20 mm. A curvature r of the interconnecting end 85 of the thick plate portion 81 chamfered in an arch shape is 10 mm.

The connecting plate 8 according to the present embodiment will be examined from a view of (A) mentioned above.

Figure 7:
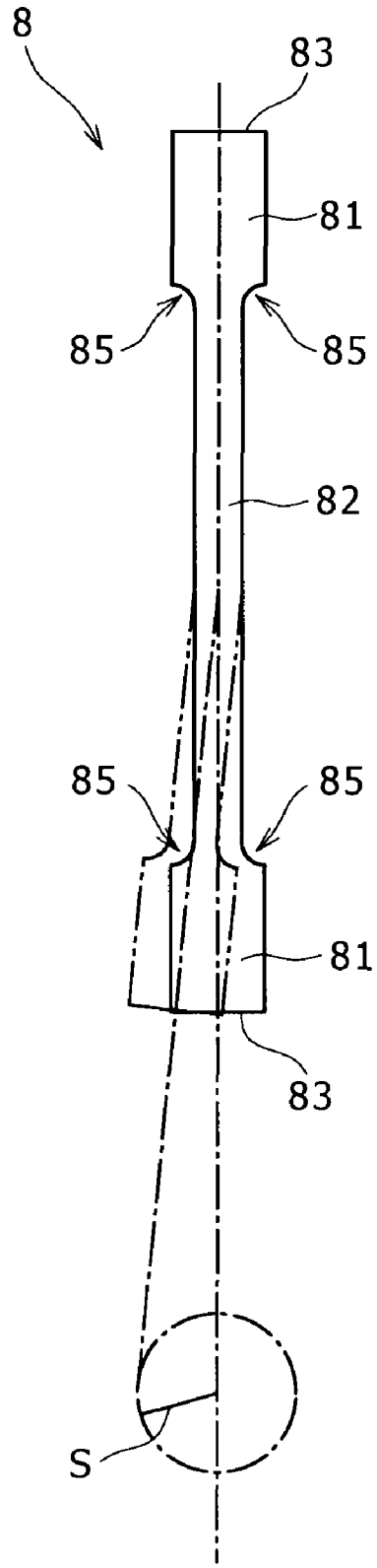
FIG. 7 is a side view showing the connecting plate and bending deformation thereof.

By lateral displacement motion included in the eccentric rotational motion of the eccentric shaft portion 56, the connecting plate 8 is bending-deformed in the anti-plane direction as shown by a two-chained line in FIG. 7.

Here, the connecting plate 8 can be modeled as a cantilever supporting beam by fixedly supporting the upper end part thereof to be attached to the interconnecting portion 34 of the mold table 3, and taking the lower end part to be attached to the attachment portion 63 of the moving bearing housing 52 as a free end. A bending stress generated when the lateral displacement constituting the eccentric rotational motion of the eccentric shaft portion 56 of the main shaft 53 is forcedly caused to the model will be determined. Hereinafter, modeling conditions for calculating the bending stress generated in the connecting plate 8 according to the present embodiment, and calculation results will be shown.

<Conditions>

Length L of the connecting plate 8: 150 mm

Distance H from the eccentric shaft center 56*a* of the eccentric shaft portion 56 to a center of the connecting plate 8: 280 mm Eccentric amount e of the eccentric shaft center 56*a* of the eccentric shaft portion 56 to the shaft center 55*a* (rotational center) of the shaft portion 55: 1.5 mm Thickness t of the connecting plate 8: 6 mm Young's modulus E of the connecting plate 8: 21000 kg/mm$^2$ <Calculation Results>

Deflection angle $\alpha$ of the lower end part of the connecting plate 8: 0.005 rad Bending stress $o_b$ generated in the connecting plate 8: 4.5 kg/mm$^2$ It should be noted that the deflection angle $\alpha$ can be calculated from a geometric positional relationship of the parts. The bending stress $\sigma_b$ can be calculated taking the deflection angle of a beam front end part of the cantilever supporting beam model as $\alpha$.

The stress generated in the connecting plate 8 by the bending deformation as mentioned above is a completely reversed tension and compression load. A stress amplitude $\sigma_a$ is 9.0 kg/mm$^2$ which is twice more than the bending stress $\sigma_b$.

Figure 8:
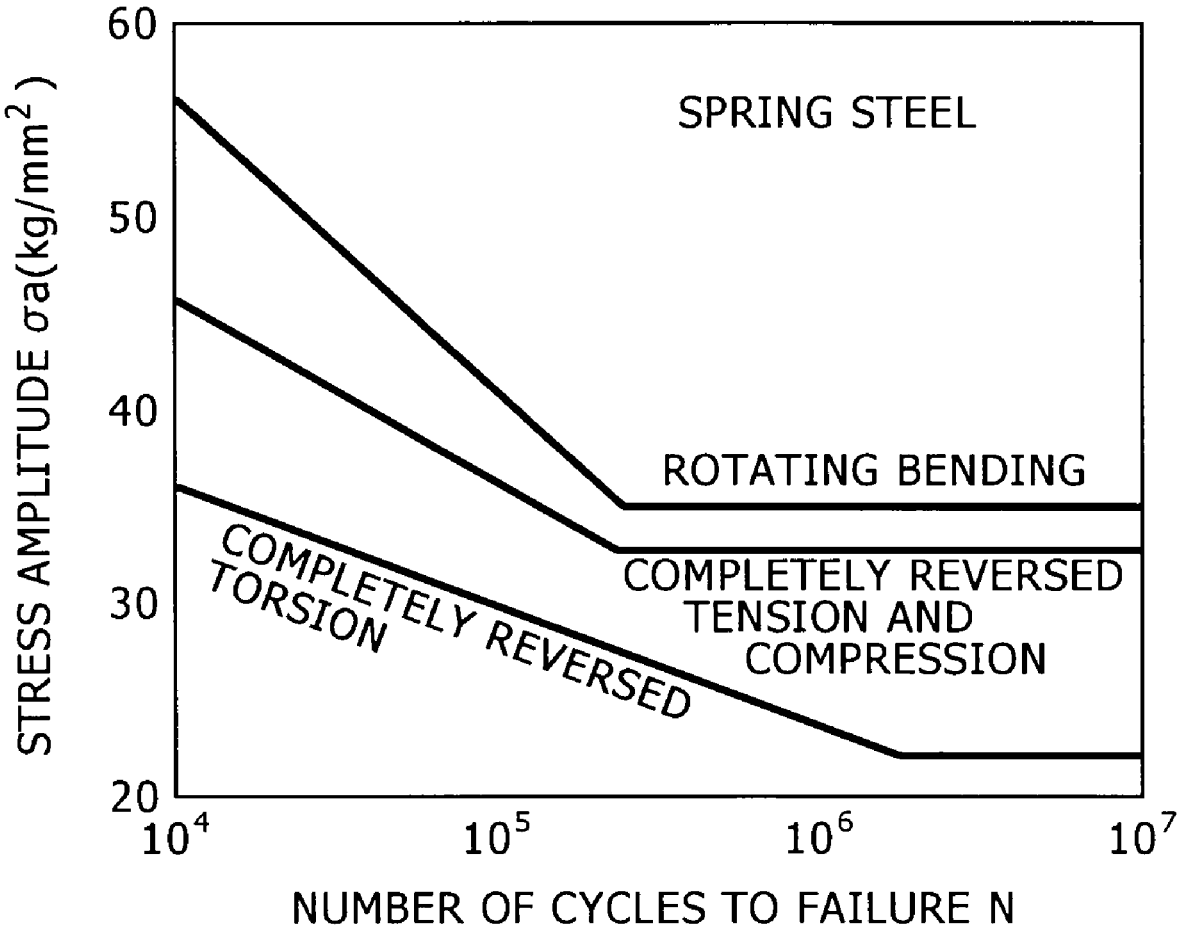
FIG. 8 is a graph showing an S-N curve of spring steel.

In the present embodiment, the connecting plate 8 is formed by the spring steel, and an S-N curve of the spring steel is shown in FIG. 8. As shown in FIG. 8, a fatigue limit of a completely reversed tension and compression stress of the spring steel is approximately 33 kg/mm$^2$. The above value is sufficiently larger than the stress amplitude $\sigma_a$ of the connecting plate 8 of 9.0 kg/mm$^2$. As a result, it can be said that the connecting plate 8 according to the present embodiment has the everlasting life to the bending deformation.

The connecting plate 8 according to the present embodiment will be examined from a view of (B) mentioned above.

On the connecting plate 8, weight of the mold table 3 and the mold 103 or the like work as the compressive load. The connecting plate 8 can be modeled as a long column by fixedly supporting the upper end part and freely supporting the lower end part. Modeling conditions and acceptable buckling load of the model will be shown below.

<Conditions>

Length L of the connecting plate 8: 150 mm

Thickness t of the connecting plate 8: 6 mm

Width b of the connecting plate 8: 250 mm

Young's modulus E of the connecting plate 8: 21000 kg/mm$^2$

<Calculation Results>

Acceptable buckling load $W_A$ of the connecting plate 8: 41477 kgf

In the case of the present embodiment, a compressive load W working on one connecting plate 8 by supporting the mold table 3, the mold 103 and the like is 3522 kgf. It can be said that the acceptable buckling load $W_A$ of the connecting plate 8 has sufficient buckling strength to the compressive load W.

Further, the connecting plate 8 according to the present embodiment will be examined from a view of (C) mentioned above. Specifically, in the case where the thick plate portion 81 of the connecting plate 8 is attached to the interconnecting portion 34 or the groove portion 65 of the attachment portion 63, the pressure of contact surface working from the interconnecting portion 34 or the attachment portion 63 on the cut end surface 83 of the thick plate portion 81 is calculated. Hereinafter, conditions required for the calculation and calculation results will be shown.

<Conditions>

Thickness t of the thick plate portion 81 of the connecting plate 8 (width of the end surface): 20 mm Length b of the thick plate portion 81 of the connecting plate 8 (length of the end surface): 250 mm Load W: 3522 kgf <Calculation Results>

Pressure of contact surface P generated on the end surface of the thick plate portion 81: 0.71 kg/mm$^2$ It should be noted that when the connecting plate 8 is formed only by the thin plate portion 82 with a thickness of 6 mm, the pressure of contact surface working on the end surface of the connecting plate 8 is 2.3 kg/mm$^2$.

Meanwhile, the pressure of contact surface value P is a sufficiently smaller value than the pressure of contact surface in the case of only the thin plate portion. As a result, there is no fear that local deformation (set) is generated in the thick plate portion 81.

Therefore, the connecting plate 8 according to the present embodiment satisfies the conditions (A) to (C) mentioned above, is not easily deformed and broken and enables a use for a long time.

As mentioned above, a proportion of the connecting plate 8 is an extremely important element for determining a performance of the connecting plate 8. When a plate thickness of the connecting plate 8 is increased more than necessary, the bending stress generated in the connecting plate 8 by the bending of the connecting plate 8 is rather increased. When the plate thickness of the connecting plate 8 is decreased more than necessary, the acceptable buckling load is reduced. When the length of the connecting plate 8 is decreased, the acceptable buckling load is increased but the bending stress generated by the bending deformation is increased. Conversely, when the length of the connecting plate 8 is increased, the bending stress generated by the bending deformation can be decreased but the acceptable buckling load is reduced.

Since a shape of the connecting plate 8 is formed into a dogbone shape in which a pair of the thick plate portions 81 are interconnected by the thin plate portion 82, the pressure of contact surface is decreased.

According to the present embodiment, the deflection of the connecting plate 8 generated by the up and down motion (up and down oscillation) of the mold table 3 in accordance with the motion of the moving bearing housing 52 due to the eccentric rotation of the eccentric shaft portion 56 is uniformly generated from one end to the other end (simple bending), and hence there is no fear that the torsional deformation is generated in the connecting plate 8.

Therefore, in an internal stress generated when the connecting plate 8 is bending-deformed as mentioned above, the bending stress due to the deflection of the thin plate portion 82 is dominant. Meanwhile, the stress due to the torsional deformation does not form an element of the internal stress. As a result, the internal stress is sufficiently smaller than the fatigue limit of the spring steel forming the connecting plate 8. Therefore, the connecting plate 8 is not broken although the internal stress is periodically generated. The life of the connecting plate 8 is prolonged.

The main shaft 53 is provided with the eccentric shaft portion 56 on the both end parts thereof, and the eccentric shaft portion 56 is supported by the moving bearing housing 52 respectively. Therefore, the size of the connecting plate 8 is reduced. Thereby, the exchange work of the connecting plate 8 is relatively easily performed.

In the above, the embodiment according to the present invention is described in detail. However, the present invention is not limited to the embodiment mentioned above. For example, it is possible to adapt a configuration that an eccentricity of the eccentric shaft portion 56 of the other main shaft 53 is smaller than an eccentricity of the eccentric shaft portion 56 of one of the main shafts 53 of a pair of the oscillating mechanisms 4. Thereby, for the mold 103 mounted on the mold table 3 is oscillated in the up and down direction on the one main shaft 53 side more than on the other main shaft 53 side, and the mold oscillating apparatus 1 can be used in a curved type continuous casting assembly having a slab conveying route curved from a lower end of the mold 103 to the other main shaft 53 side.

Figure 10:
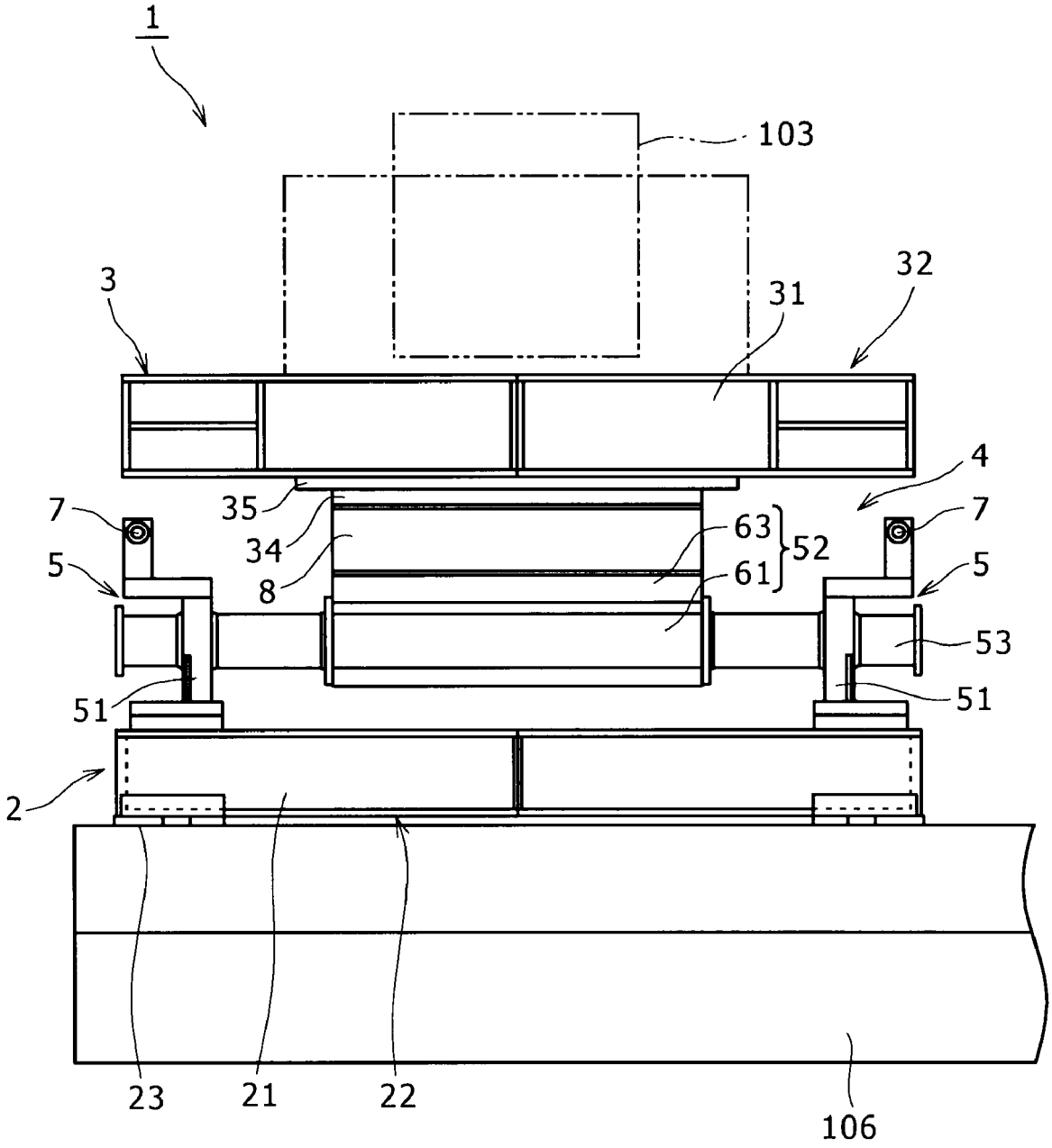
FIG. 10 is a front view of another mold oscillating apparatus according to the present invention.

As shown in FIG. 10, in the case of adapting a configuration that the eccentric shaft portion 56 is formed in an elongate shape in the central part of the main shaft 53, and the moving bearing housing 52, the attachment portion 63, the connecting plate 8 and the interconnecting portion 34 of the mold table 3 are formed in accordance with length of the eccentric shaft portion 56, the same effect is exhibited as the present embodiment.

Figure 11:
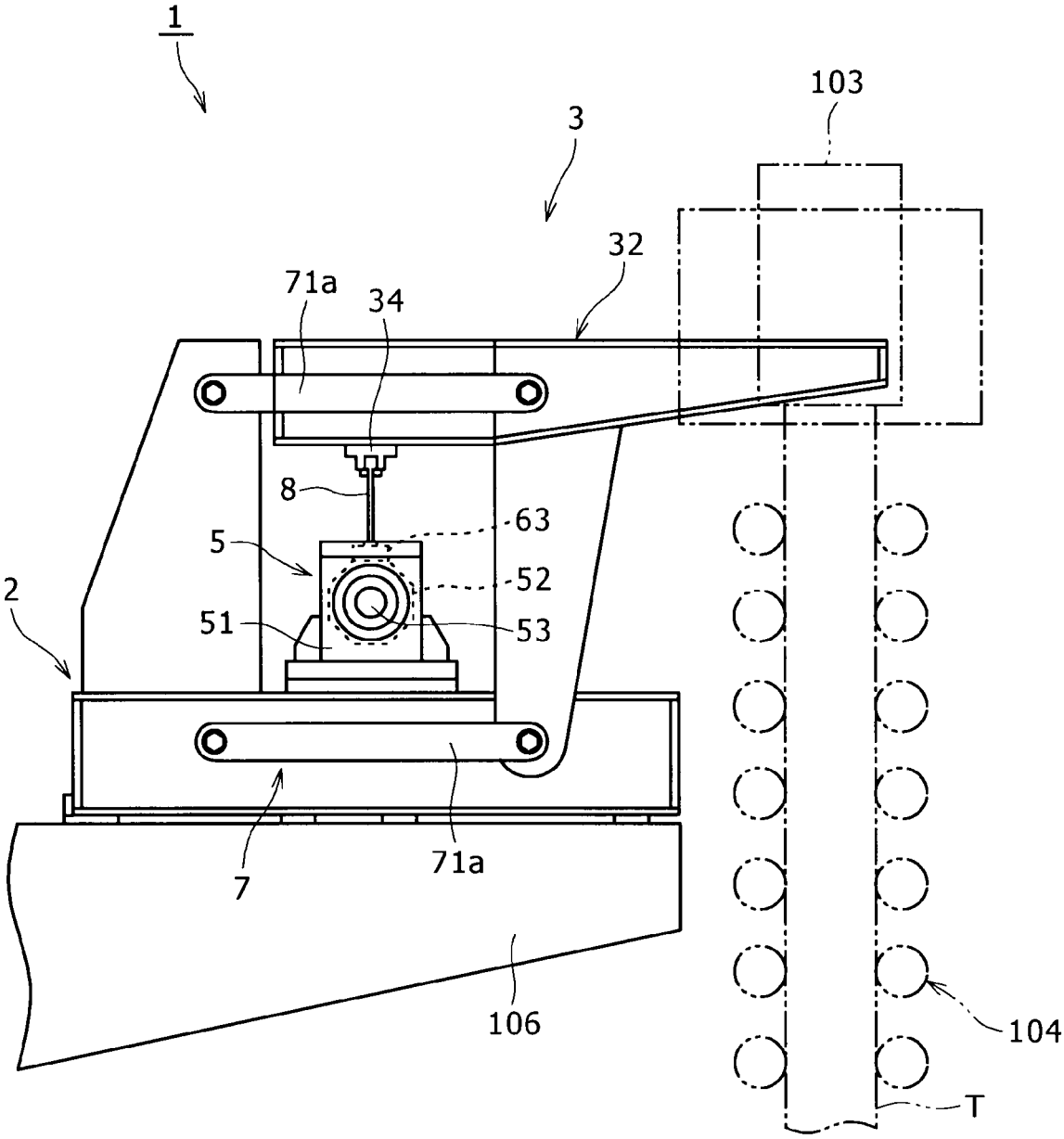
FIG. 11 is a side view of further another mold oscillating apparatus according to the present invention.

As shown in FIG. 11, even with a configuration that one oscillating mechanism 4 is arranged between the base frame 2 and the mold table 3, the same effect is exhibited as the present embodiment. In FIG. 11, as the oscillation direction regulating means 7, a link mechanism including a pair of upper and lower link pieces 71*a* is adapted. Thereby, an oscillating orbit of the mold 103 is an arc shape having a link length as a radius. However, since the amplitude is small, the lateral displacement due to the arc motion is extremely small and hence can be ignored. It is possible to adapt a configuration that a tie rod is arranged instead of one of the upper and lower link pieces 71*a* or both the link pieces 71*a*, one end of the tie rod is fixed to the mold table 3, and the other end is fixed to the base frame 2.

Figure 12:
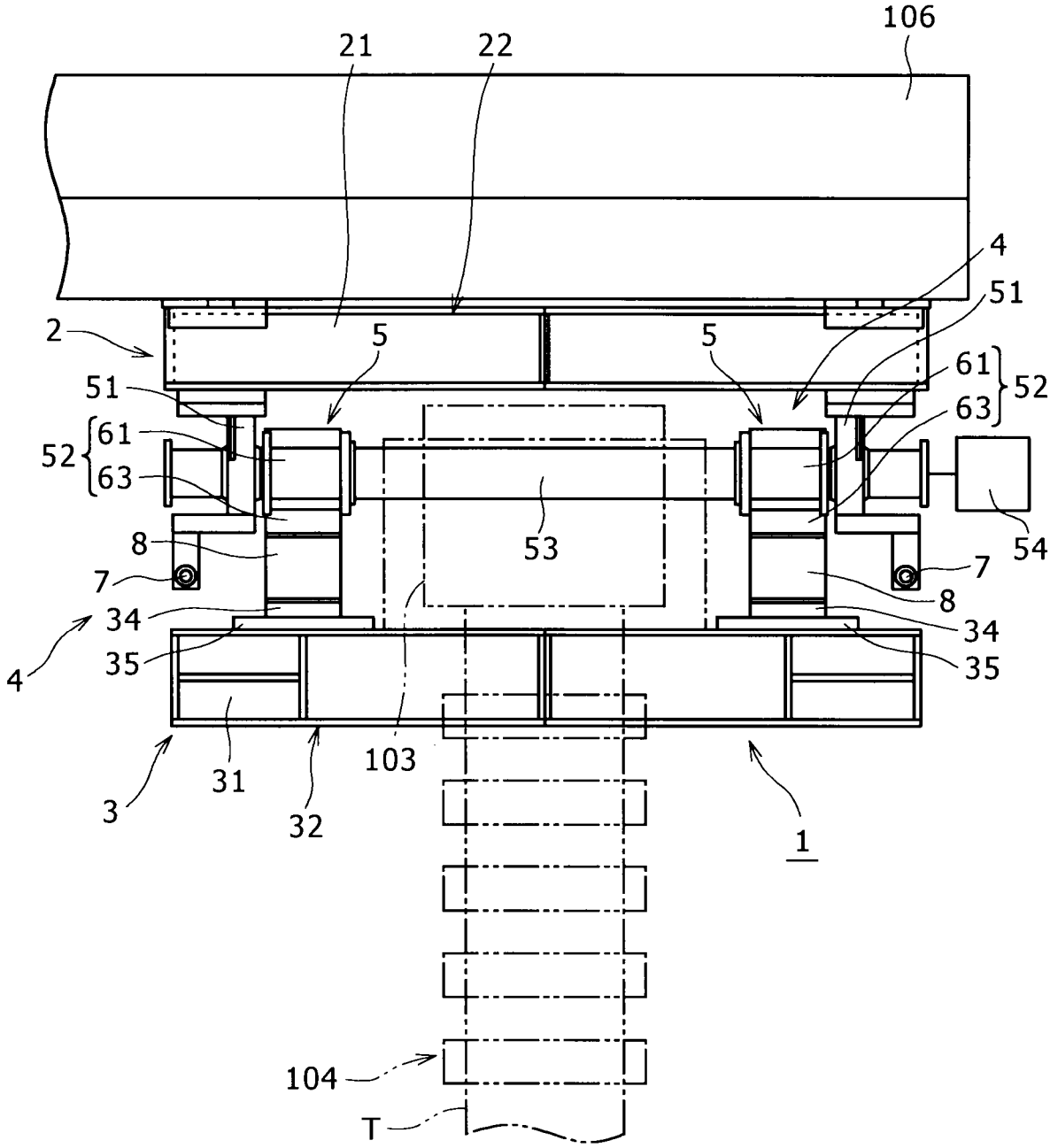
FIG. 12 is a front view of the other mold oscillating apparatus according to the present invention.

As shown in FIG. 12, it is possible to adapt a configuration that the mold table 3 is supported on the lower side of the base frame 2. In such a configuration, while a tensile force works on the connecting plate 8, the compressive load does not work. Therefore, it is possible to form the connecting plate 8 only in a thin plate shape, and also form the connecting plate 8 so as to have a thinner thickness than the connecting plate 8 according to the above embodiment.

In the present embodiment, as the material of the connecting plate 8, the spring steel having a high fatigue limit is adapted. However, the material does not necessarily stick to the above, and it is possible to adapt a material having the completely reversed tension and compression stress which is equal to or less than the fatigue limit such as a rolled plate for general structures, a carbon steel material for machine structures, and stainless steel. It is possible to form the shape of the connecting plate 8 into a trapezoid shape in which the length of any of the thick plate portions 81 in the plate extending direction is shorter than the length of the other thick plate portion 81 in the plate extending direction. It is possible to select the material of the connecting plate 8 from a view that the connecting plate 8 has the limited life (equal to or more than the fatigue limit) in consideration to an economic efficiency.

It is possible to adapt a configuration that only one end part of the tie rod 71 of the oscillation direction regulating means 7 is supported by the interconnecting means 73.

We claim:

1. A mold oscillating apparatus, comprising:

a mold table for supporting a mold;

a base frame for supporting said mold table on the upper side or the lower side thereof, and an oscillation mechanism for oscillating said mold table, the oscillation mechanism being arranged between said base frame and said mold table, the oscillation mechanism comprising:

drive means;

a stationary bearing housing interconnected to said base frame;

a moving bearing housing interconnected to said mold table;

oscillation generating means provided with a shaft interconnected to said drive means, said shaft having a shaft portion supported by said stationary bearing housing and an eccentric shaft portion supported by said moving bearing housing;

oscillation direction regulating means for regulating lateral displacement and accepting up and down displacement, in oscillation of said mold table generated by said oscillation generating means; and a connecting plate arranged between said moving bearing housing and said mold table, the connecting plate extending in the axial direction of said shaft, being supported by said mold table from one end of an end part opposing to said mold table to the other end, and being supported by said moving bearing housing from one end of an end part opposing to said moving bearing housing, wherein said connecting plate absorbs the lateral displacement regulated by said oscillation direction regulating means with elastic deformation.

2. The mold oscillating apparatus according to claim 1, wherein said shaft is provided with said eccentric shaft portion on both ends thereof respectively, and said eccentric shaft portion is supported by said moving bearing housing respectively.

3. The mold oscillating apparatus according to claim 1, wherein at least a pair of said oscillation mechanisms are arranged between said base frame and said mold table, and shaft centers of said shafts provided in said oscillation mechanisms are parallel to each other.

4. The mold oscillating apparatus according to claim 3, wherein in said pair of said oscillation mechanisms, an eccentricity of said eccentric shaft portion provided in one of said shafts is set to have a different value from an eccentricity of said eccentric shaft portion provided in the other shaft.

5. The mold oscillating apparatus according to claim 3, wherein in said pair of said oscillation mechanisms, the rotation direction of one of said shafts and the rotation direction of the other shaft are set to be opposite to each other.

6. The mold oscillating apparatus according to claim 1, wherein said connecting plate is fixed by fitting an upper end part thereof to a groove portion provided in said mold table.

7. The mold oscillating apparatus according to claim 1, wherein said connecting plate is fixed by fitting a lower end part thereof to a groove portion provided in said moving bearing housing.

8. The mold oscillating apparatus according to claim 1, wherein said connecting plate has high fatigue property to bending deformation due to the lateral displacement included in motion of said moving bearing housing upon rotation of said eccentric shaft portion of said shaft, and strength capable of avoiding buckling due to a compressive load from said mold table and deformation in an upper end part thereof interconnected to and supported by said mold table and a lower end part thereof interconnected to and supported by said moving bearing housing due to the compressive load.

9. The mold oscillating apparatus according to claim 1, wherein said connecting plate is provided with one thick plate portion interconnected to and supported by said mold table on an upper end part thereof, the other thick plate portion interconnected to and supported by said moving bearing housing on a lower end part thereof, and a thin plate portion extending between a pair of the thick plate portions, and an interconnecting portion of the thick plate portion and the thin plate portion is chamfered.

10. The mold oscillating apparatus according to claim 1, wherein said connecting plate is formed by spring steel.

* * * * *